United States Patent [19]

Kotter et al.

[11] 4,077,196

[45] Mar. 7, 1978

[54] FIBER DISPERSING AND FEEDING APPARATUS FOR OPEN END SPINNING

[75] Inventors: James I. Kotter, Mandeville, La.; Charles B. Hassenboehler, Knoxville, Tenn.; Craig L. Folk, New Orleans, La.

[73] Assignee: The United States of America as represented by the Secretary of Agriculture, Washington, D.C.

[21] Appl. No.: 737,979

[22] Filed: Nov. 2, 1976

[51] Int. Cl.[2] ..... D01H 1/12

[52] U.S. Cl. ..... 57/58.95

[58] Field of Search ..... 57/58.95

[56] References Cited

U.S. PATENT DOCUMENTS

| | | | |
|---|---|---|---|
| 3,688,487 | 9/1972 | Fukuta et al. | 57/58.95 |
| 3,908,349 | 9/1975 | Vrifu et al. | 57/58.95 X |
| 3,981,133 | 9/1976 | Neubert et al. | 57/58.95 |
| 4,002,016 | 1/1977 | Fischer et al. | 57/58.95 |
| 4,005,568 | 2/1977 | Folk | 57/58.95 X |

*Primary Examiner*—Richard C. Queisser
*Assistant Examiner*—Charles Gorenstein
*Attorney, Agent, or Firm*—M. Howard Silverstein; David G. McConnell; Salvador J. Cangemi

[57] ABSTRACT

Under influence of positive and negative aerodynamic action imposed on a conic surface, airborne fibers and tufts are compelled to disperse approximately 360° and to enter the rotor of an open-end yarn spinner device, peripherally, thereby minimizing identifiable yarn imperfections and inefficiencies attributive to open-end yarn formation.

1 Claim, 7 Drawing Figures

FIBER DISPERSING AND FEEDING APPARATUS FOR OPEN END SPINNING

CROSS-REFERENCES TO RELATED PATENTS

U.S. Pat. No. 4,005,568, "Self Cleaning Open-end Spinning Apparatus", C. Folk.

U.S. Pat. No. 3,685,100, "Card Cover with Fiber Conveying Channels", Brown, et al.

U.S. Pat. No. 3,858,277, "Spiral Carding Apparatus", Brown, et al.

PRIOR ART AND BACKGROUND OF INVENTION

1. Field of Invention

This invention relates to a method and apparatus for pneumatically dispersing and feeding individualized fibers peripherally into an open-end spinning unit, for example, as described in U.S. Pat. No. 4,005,568.

More specifically, the invention relates to a method and apparatus for continuously guiding and depositing opened fibers into the peripheral area (approximately 360° ) of the yarn formation zone within a spinner rotor.

2. Description of Prior Art

To those familiar with the art of textile processing and particularly, the commercial open-end methods of producing yarn, it is known that "folded" fibers and fiber "wrap-around" contributes toward forming thick and thin yarn areas, poor distribution of load among the fibers, and subsequently poor yarn strength. These "inherent" construction imperfections are chiefly responsible for yarn breakage resulting in spinner down-time. It is because of these factors open-end yarn is considered by some textile authorities to be inferior to ring spun yarn.

It is also known that the "point feed" method of introducing fibers, that is through a high velocity venturi orifice into the rotor causes abrasions and rapid wear of the yarn formation surface area requiring rotor replacement at frequent intervals.

SUMMARY AND OBJECTS OF THE INVENTION

In opposition to the "point feed" technique generally employed in conventional open-end yarn spinners, the diffused peripheral introduction of fibers into the rotor eliminates the cause of many yarn imperfections and inefficiencies commonly found in the production of conventional open-end spun yarn, for example, folded fibers, fiber wrap-around, thick and thin spots, frequency of ends-down, excessive rotor wear, et cetera.

Improved production efficiency and quality of the finished spun yarn are achieved by the unique truncated cone design which compels airborne fibers to disperse approximately 360° into an open-end yarn spinner.

The primary objective of this invention is to improve strength and overall quality of open-end yarns.

Another object of this invention is to greatly reduce or eliminate the occurance of fiber "wrap-around" and fiber "folding" within open-end yarns.

Another object of this invention is to reduce the frequency of ends-down during yarn formation.

Another object of this invention is to significantly reduce abrasive wear in the yarn formation area of the open-end spinner rotor.

Another object of this invention is to diffuse and distribute fibers evenly to approximately 100% of the yarn formation zone of the open-end spinner rotor.

Another object of the invention is to prevent fiber contact and entanglement with the plurality formed yarn or "tail" as it is being withdrawn from the rotor.

Further objects and advantages of the invention will be apparent from the following specifications, drawings, and claims set forth herein.

DESCRIPTION OF THE PREFERRED EMBODIMENTS

Figure 1:
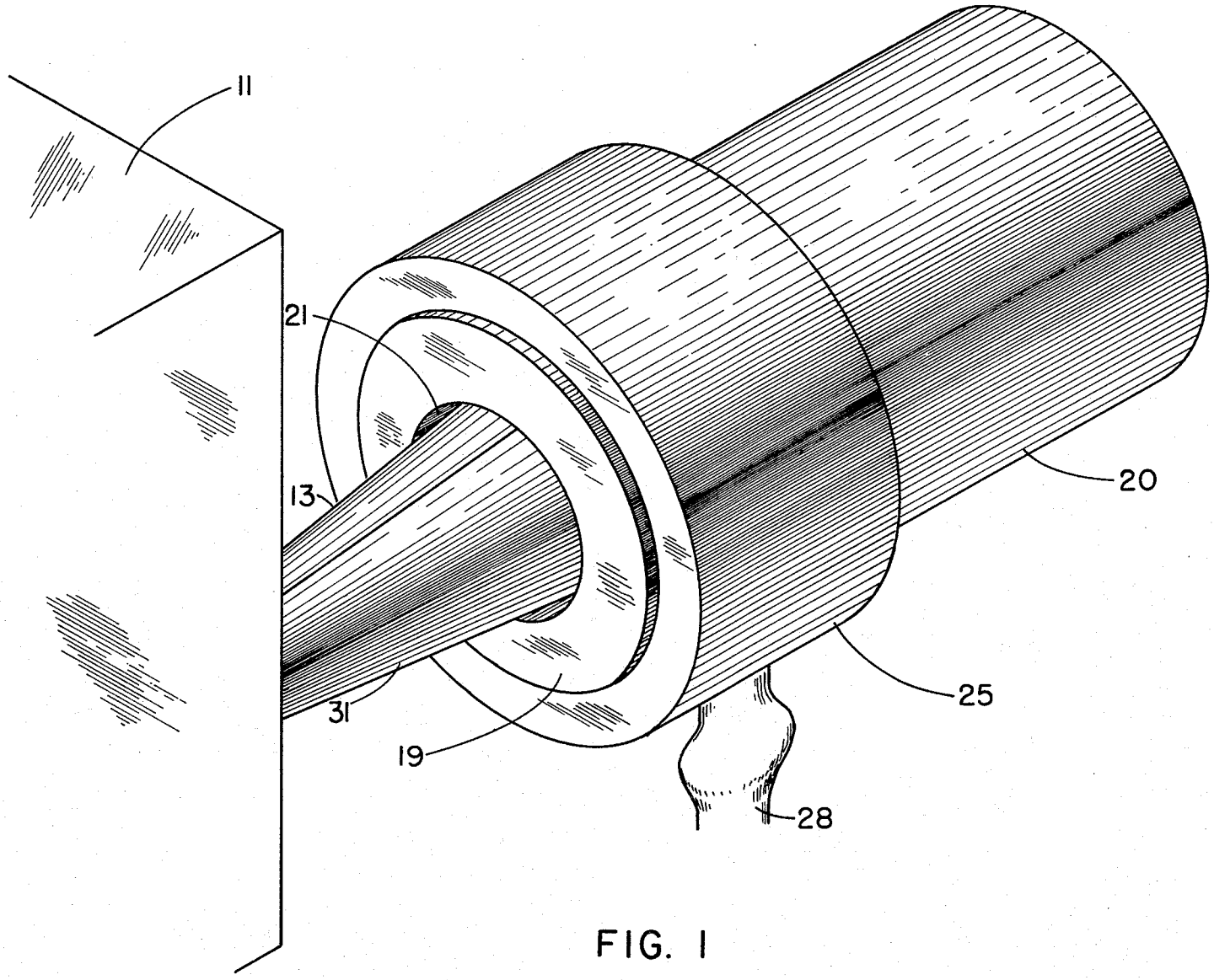
FIG. 1 is a three dimensional view of an embodiment of the invention depicting a truncated conical fiber dispersing and feeding means for an open-end rotor spinner.
Figure 2:
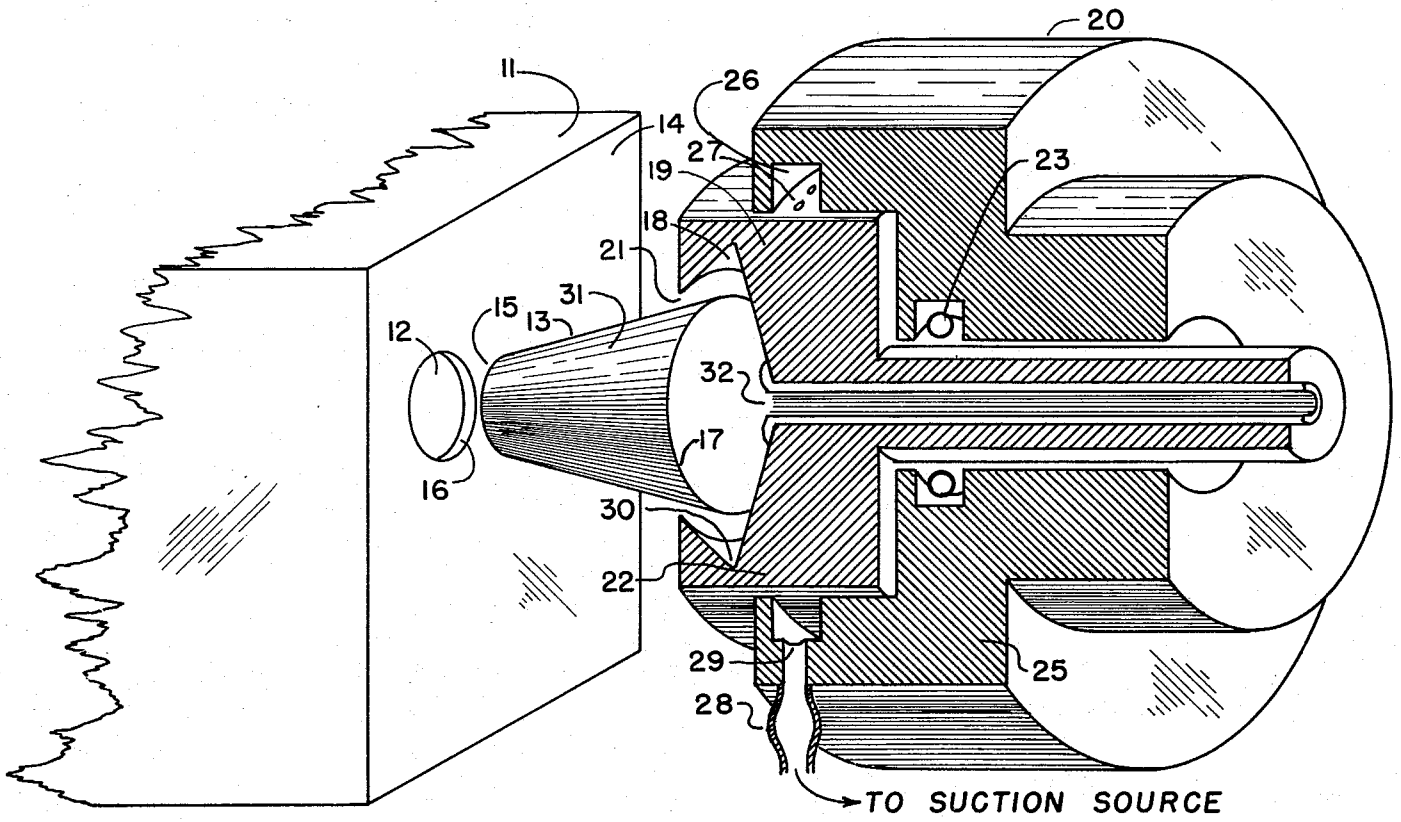
FIG. 2 is a three dimensional view of an embodiment of the invention with a portion of the open-end spinner in cross-section to show air passages and clearance relationships.
Figure 3:
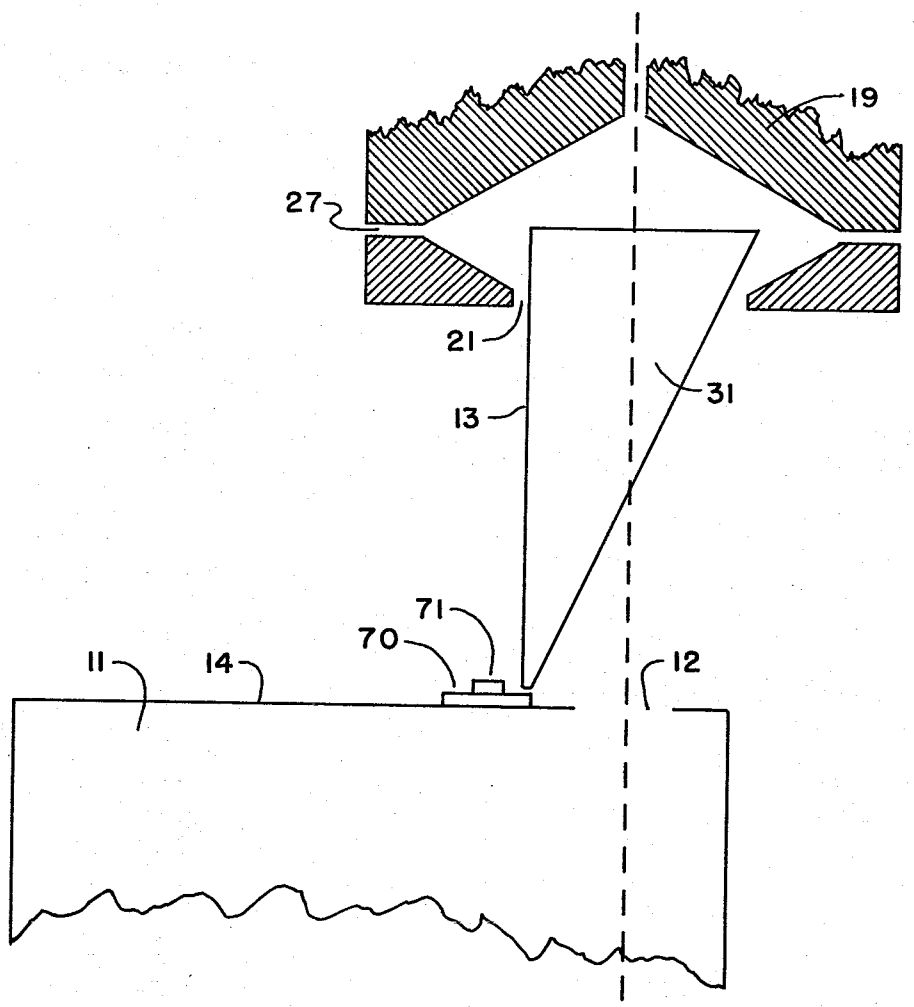
FIG. 3 is a plan view of an embodiment of the invention with portions in cross-section to show position relationship between fiber opening means and open-end spinning apparatus.

Referring to the drawings, FIGS. 1, 2 and 3 depict an embodiment of the invention wherein textile fibers (not shown) are discharged from an opening device 11 such as a spiral carding apparatus U.S. Pat. Nos. 3,685,100 and 3,858,277, impinged upon a truncated conical deflector 13 and subsequently spun into yarn (not shown), by an open-end spinning apparatus, U.S. Pat. No. 4,005,568. Textile fibers are individualized by the action of the fiber opening apparatus 11 and they are discharged within an air-stream under positive air pressure through portal 12 of apparatus 11.

Truncated conical deflector 13 is mounted onto forward face 14 of opening apparatus 11 by means of bored flange 70 and bolt 71 fitted into a tapped hole (not shown) in apparatus 11. Deflector 13 has its truncated apex 15 coincident with and extending along face 16 of portal 12.

The deflector 13 is smaller than rotor entrance rim 18 of open-end spinner 20 thus permitting the permanent symmetrical positioning of a portion of deflector 13 within the confines of rotor 19. Deflector 13 is positioned to establish equidistant, circular passages 21 and 22, extending 360° circumferentially about rotor 19.

Rotor 19 is an integral part of open-end spinner 20 and it is rotatably mounted in ball bearings 23 and 24 (not shown) which are fitted into and supported by housing 25 of open-end spinner 20.

Rectangularly shaped air passage 26 is circularly formed into housing 25 of rotor 19. Air passage 26 is joined to a suction source (not shown) by means of tubular connection 28 extending from round opening 29. Therefore, the air intake for the suction source is circular passage 21. The flow path of air under negative pressure is through circular passage 21 into vertex 30 of rotor 19, through peripheral circular openings 27 of rotor 19 into rectangular air passage 26 of housing 25, through round opening 29 and tubular connection 28 into a tubular conduit (not shown) which is connected to the suction source (not shown).

As the airstream (under positive pressure) ladened with fibers is discharged from portal 12, it impinges upon conical deflector 13. Because of the Coanda Effect, the fiber ladened airstream clings to and follows conical surface 31 spreading circumferentially as it traverses. As the dispersing fibers approach circular passage 21, force from the airstream (under negative pressure) entering said passage 21, is exerted upon the fibers, accelerating them into the confines of rotor 19 and subsequently into its vertex 30. Said fibers are aligned parallel with circumferential holes 27 of rotor 19, prior to being spun into yarn.

Conical deflector 13 aids in directing fibers into apex 30 and prevents fiber contact and subsequent entanglement with the newly formed yarn (not shown) in area A, whose boundaries are established circumferentially between passage 22 and yarn entrance 32.

The position of conical deflector 13, as shown in FIGS. 1, 2 and 3 is not critically essential to the operation of the invention. Conical deflector 13 may be positioned with its solid surface 31 adjacent to and coincident with either side of portal 12 in the vertical or the horizontal plane. Spinner 20 however, should be in the center alignment with portal 12 in any position deflector 13 is utilized.

Figure 4:
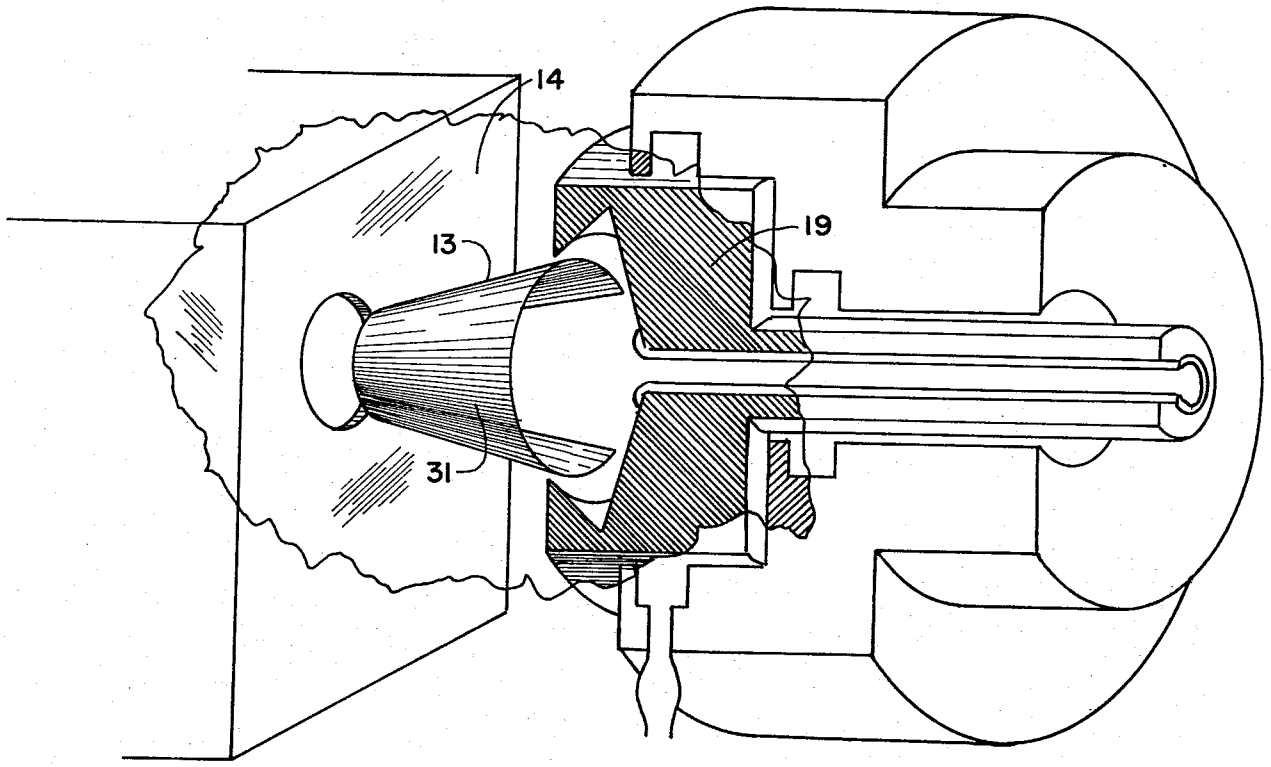
FIG. 4 is a three dimensional view of an alternate embodiment of the invention with portions in cross-section to show an increment removed from the fiber contacting surface of the conical deflector.

Referring to FIG. 4, deflector 13 may have a section or increment removed from its fiber contacting surface 31 for simplification of start-up procedure. The invention is functional with approximately 90° of the cone removed.

Figure 5:
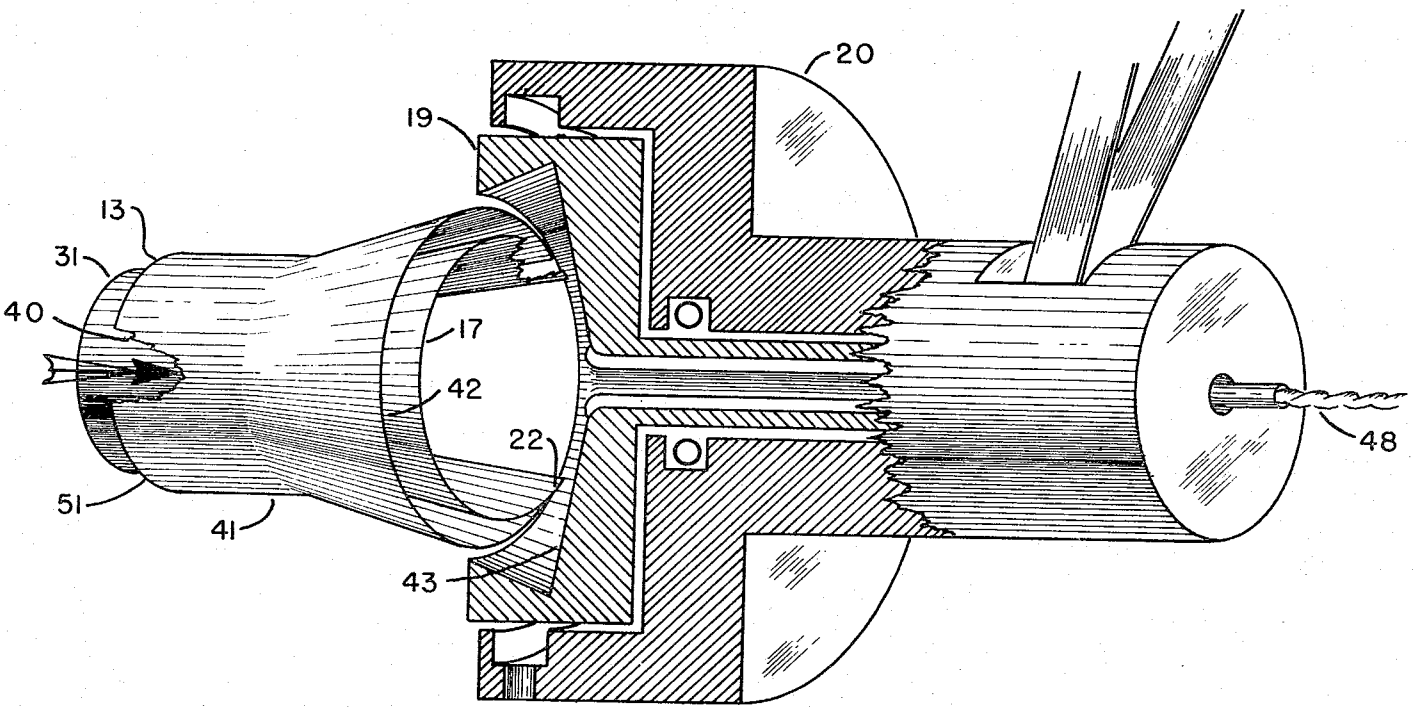
FIG. 5 is a three dimensional view of another embodiment of the invention depicting a shrouded truncated conical fiber dispersing and feeding means with clearances therebetween for controlled fiber dispersing into the open-end rotor.

In another embodiment of the invention we refer now to FIG. 5, where textile fibers (not shown) are discharged from an opening device (not shown) into circular passage 40 formed by surface 31 of truncated conical deflector 13 and a truncated conically shaped shroud 41. Shroud 41 is similar in shape to deflector 13, but it is larger in diameter, thereby establishing circular passage 40 between deflector 13 and shroud 41.

The diagonal extremity of flared terminal end 42 of shroud 41 is smaller than rotor entrance rim 18 of open-end spinner 20, to provide clearance and thus prevent interference as the rotor 19 rotates.

Circularly shaped fiber passage 40 formed by deflector 13 and shroud 41, symmetrically positioned, extends into the confines of rotor 19 to prevent fiber loss and to more effectively distribute fibers peripherally into rotor 19.

Circular passage 22 is established between rim 17 of deflector 13 and wall 43 of rotor 19 for freedom of movement and withdrawal of newly formed yarn 48 from confines of rotor 19.

Both deflector 13 and shroud 41 may have a section or increment removed from their fiber contacting surfaces, 31 and 51 respectively, for simplification of start-up procedure. The invention is functional, with approximately 90° of corresponding sections (not shown) of deflector 13, and shroud 41 removed.

Figure 6:
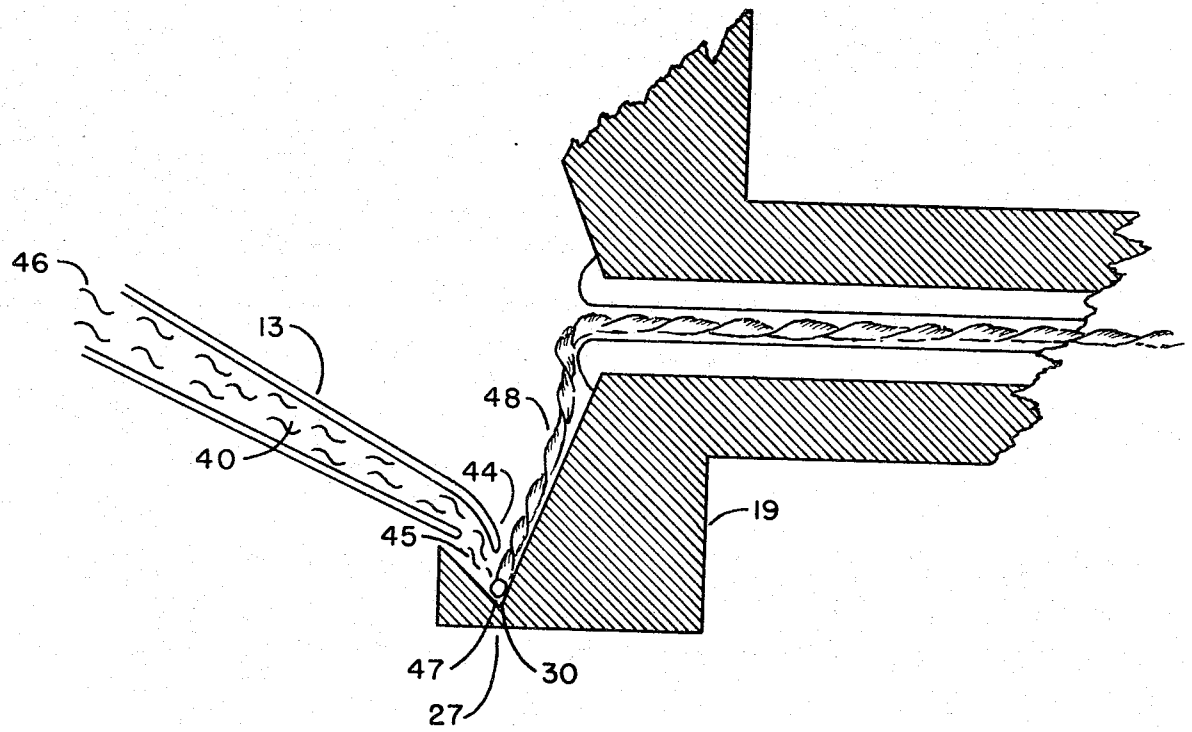
FIG. 6 is a cross-sectional view of an embodiment of the invention wherein the shrouded conical deflecting means has a directional nozzle extending circularly into the open-end spinner rotor.

Referring to FIG. 6, in this embodiment conical deflector 13 has a protruding, rounded edge 44 forming directional nozzle 45 which extends circularly into and about rotor 19.

The purpose of nozzle 45 is to precisely direct the fibers into vertex 30 of spinner rotor 19 and to prevent fibers 46 from contacting the upper portion of "tail" 47 of partially formed yarn 48 as it is being removed from the confines of rotor 19.

The airstream's negative velocity is sufficient to accelerate the fibers through converging passage 40 thereby straightening the fibers as they emerge from nozzle 45 into vertex 30.

Referring to FIGS. 5 and 6, when feeding into a spinning unit as described in patent application Ser. No. 633,066, the fibers align and mat themselves over the peripheral holes 27 which possess the least amount of air flow restriction. That is, in continuous operation, the airborne fibers are placed by nozzle 45 and by the flowing airstream over unrestricted peripheral holes 27 not covered by "tail" 47 as it continually rotates about its own axis and the axis of rotor 19 lapping fibers and forming then into yarn 48 in vertex 30 of rotor 19.

The fibers 46 are aerodynamically directed away from "tail" 47 as the yarn 48 is being formed, thus preventing the formation of many types of yarn imperfections.

Figure 7:
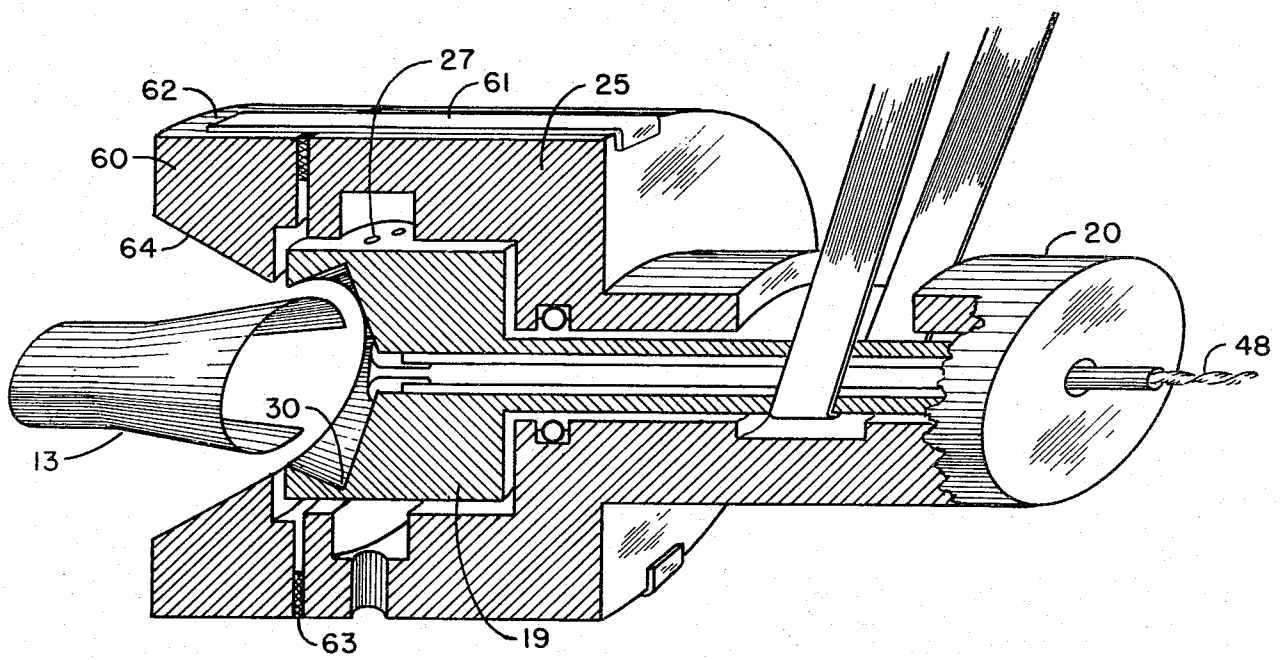
FIG. 7 is a three dimensional view of another embodiment of the invention employing a circular fiber entrance deflector attached to the spinner housing.

Referring to FIG. 7, onto housing 25 of open-end spinner 20 is attached circularly symmetrical deflector 60. Multiple spring clips 61 are attached to peripheral surface 62 of deflector 60 as a means of non-permanent fastening to housing 25 of open-end spinner 20. Deflector 60 however, may be attached permanently to or machined into housing 25 to clear rotor 19 of spinner 20 by means of a continuous or non-continuous pertuberance 63.

The angle of the circular deflecting surface 64 of deflector 60 may range from 15° to 45° measured from the centerline or rotational axis of rotor 19.

The intake air velocity created by an outside suction source (not shown) and/or by the centrifugal pumping action of air through peripheral holes 27 of rotor 19 steadily increases as it flows through venturi configuration formed by conical surface 31 of conical deflector 13 and circular surface 64 of deflector 60.

The purpose of deflector 60 is to direct all fibers discharged from the opening device (not shown) into the negative air stream and subsequently into vertex 30 of rotor 19 to be formed into yarn 48.

We claim:

1. Textile processing apparatus comprising:
   a. an opening apparatus having a discharge portal;
   b. an open-end rotor spinner; and
   c. a truncated cone with an opening along the side thereof and with its wide end dispersed inside the opening of, but spaced from, said rotor spinner, and wherein the truncated end of said cone is disposed adjacent said portal so that textile fiber is discharged from said opening apparatus through said portal upon the outer surface of said cone near the truncated end, said fiber directed and dispersed into said open-end spinner;
   d. a truncated conically-shaped shroud which substantially completely surrounds, and is spaced from, said cone to define an annular passage therebetween, said shroud having an opening along the side thereof adjacent to the opening along the side of said cone of (c).

* * * * *